US005327599A

United States Patent [19]

Bradley, Jr.

[11] Patent Number: 5,327,599

[45] Date of Patent: Jul. 12, 1994

[54] HOSPITAL BED WITH BED PAN INSERT

[76] Inventor: James B. Bradley, Jr., 4805 Inverness Dr., Tyler, Tex. 75703

[21] Appl. No.: 121,152

[22] Filed: Sep. 13, 1993

[51] Int. Cl.[5] ..... A61G 7/02

[52] U.S. Cl. ..... 5/604; 5/463

[58] Field of Search ..... 5/463, 604

[56] References Cited

U.S. PATENT DOCUMENTS

| | | | |
|---|---|---|---|
| 169,705 | 11/1975 | Huntress . | |
| 787,162 | 4/1905 | Feely . | |
| 1,844,864 | 2/1932 | Saunders | 5/604 |
| 2,116,171 | 5/1938 | Harris | 5/463 |
| 2,318,240 | 5/1943 | Mas | 5/604 |
| 2,418,259 | 4/1947 | Harmanson | 5/90 |
| 2,521,341 | 9/1950 | Carroll | 5/90 |
| 2,932,831 | 4/1960 | Keathley, Sr. et al. | 5/604 |
| 3,623,170 | 11/1971 | Staley et al. | 5/463 |
| 3,922,735 | 12/1975 | Kato | 5/91 |
| 3,943,583 | 3/1976 | Ishikawa | 5/90 |
| 3,959,833 | 6/1976 | Burke | 5/90 |
| 4,016,005 | 4/1977 | DiMatteo | 297/DIG. 10 |
| 4,631,762 | 12/1986 | Fugett | 5/90 |
| 4,677,700 | 7/1987 | Su | 5/604 |
| 4,833,742 | 5/1989 | Kuhn | 5/604 |
| 4,944,058 | 7/1990 | Carnahan et al. | 5/90 |
| 5,134,737 | 8/1992 | Wyman | 5/604 |
| 5,189,745 | 3/1993 | Workman et al. | 5/604 |

FOREIGN PATENT DOCUMENTS

| | | | |
|---|---|---|---|
| 724310 | 2/1955 | United Kingdom | 5/604 |

*Primary Examiner*—Alexander Grosz

*Attorney, Agent, or Firm*—Ross, Howison, Clapp & Korn

[57] ABSTRACT

A bed includes a mattress having a head section, foot section, and a medial section disposed between the head and foot sections. A frame supports the mattress sections. A plate is disposed within the frame for supporting the mattress medial section. The plate is mounted within the frame for horizontal slidable movement between a closed position in which the mattress sections form a continuous surface for the bed, and an open position transverse of the frame to create a recess in the mattress medial section thereby moving the mattress medial section outwardly of the frame. A bed pan is adapted to be disposed within the recess created in the mattress medial section when the plate is in the open position.

3 Claims, 3 Drawing Sheets

HOSPITAL BED WITH BED PAN INSERT

TECHNICAL FIELD OF THE INVENTION

The present invention relates to hospital beds, and more particularly to a hospital bed with a bed pan insert.

BACKGROUND OF THE INVENTION

A disagreeable aspect of a patient's stay in a hospital is the use of a hospital bed pan. A bed pan is difficult to sit on, is unstable, is not large enough, and is different from a commode seat which the patient is accustomed to using. Physicians, nurses, and patients generally agree that there is a need for a bed pan that is more comfortable and acceptable. Rather than try to use the hospital bed pan, many patients, against doctor's orders, attempt to get out of bed to go to the bathroom. This is a dangerous practice and has been the cause of patient accidents and setbacks. Accordingly, there is a need for a simple, practical, and relatively inexpensive way to simulate a commode to which the patient is accustomed to using in his own home without the need for the patient to leave a bed. Also, there is a need to make the waste disposal procedure as simple and convenient as possible for the hospital nurses.

SUMMARY OF THE INVENTION

In accordance with the present invention, a bed for use with a bed pan is provided. The bed includes a mattress having a head section, foot section, and a medial section disposed between the head and foot sections. A frame is provided for supporting the mattress sections. A plate is disposed within the frame for supporting the mattress medial section. The plate is mounted within the frame for horizontal slidable movement between a closed position in which the mattress sections form a continuous surface for the bed, and an open position transverse of the frame to create a recess in the mattress medial section thereby moving the mattress medial section outwardly of the frame. A bed pan is adapted to be disposed within the recess created in the mattress medial section when the plate is in the open position.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
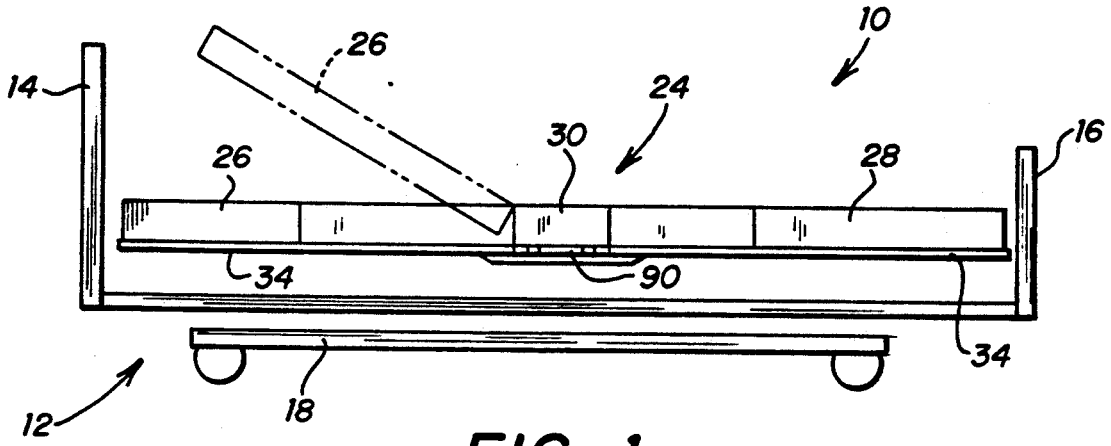
FIG. 1 is a side elevational view of the present hospital bed.

Referring simultaneously to FIGS. 1–4, a hospital bed, generally identified by the numeral 10 is illustrated.

Hospital bed 10 includes a standard frame, generally identified by the numeral 12 having a head board portion 14, a foot board portion 16 and a support structure 18. Hospital bed 10 includes a mattress, generally identified by the numeral 24. Mattress 24 includes a head section 26, a lower body or foot section 28 and a medial section 30. Mattress sections 26, 28 and 30 are supported on a frame 34, which in turn is supported on bed frame 12 in a manner well known to those skilled in the art.

Figure 2:
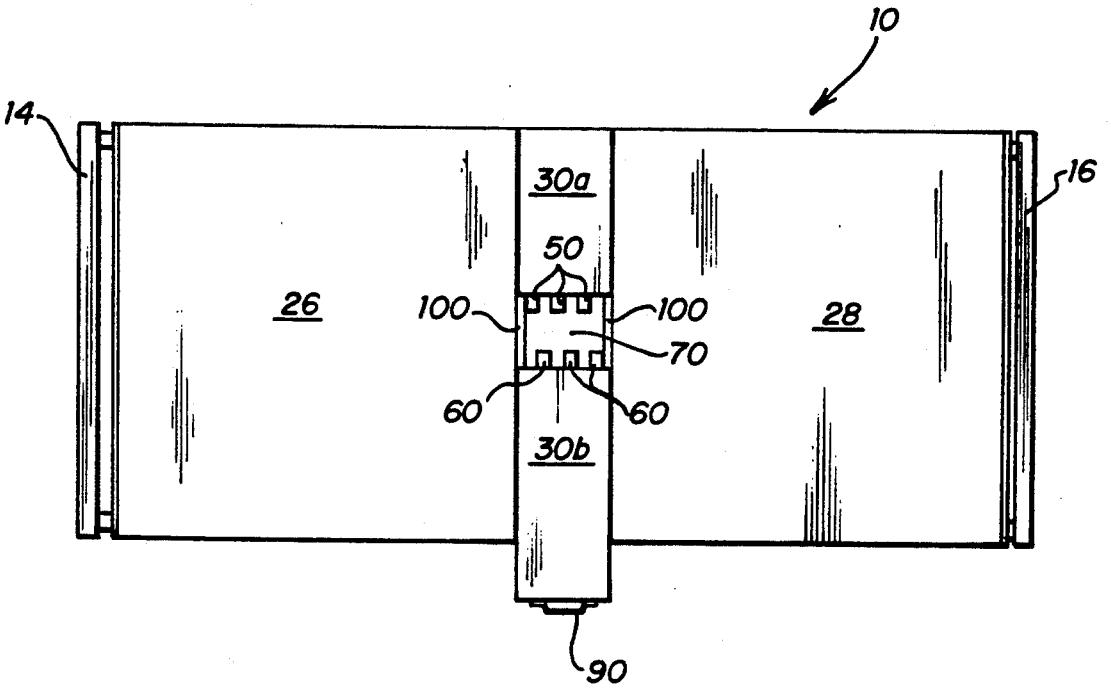
FIG. 2 is a top plan view of the present hospital bed illustrated in FIG. 1 illustrating the plate in the open position.
Figure 3:
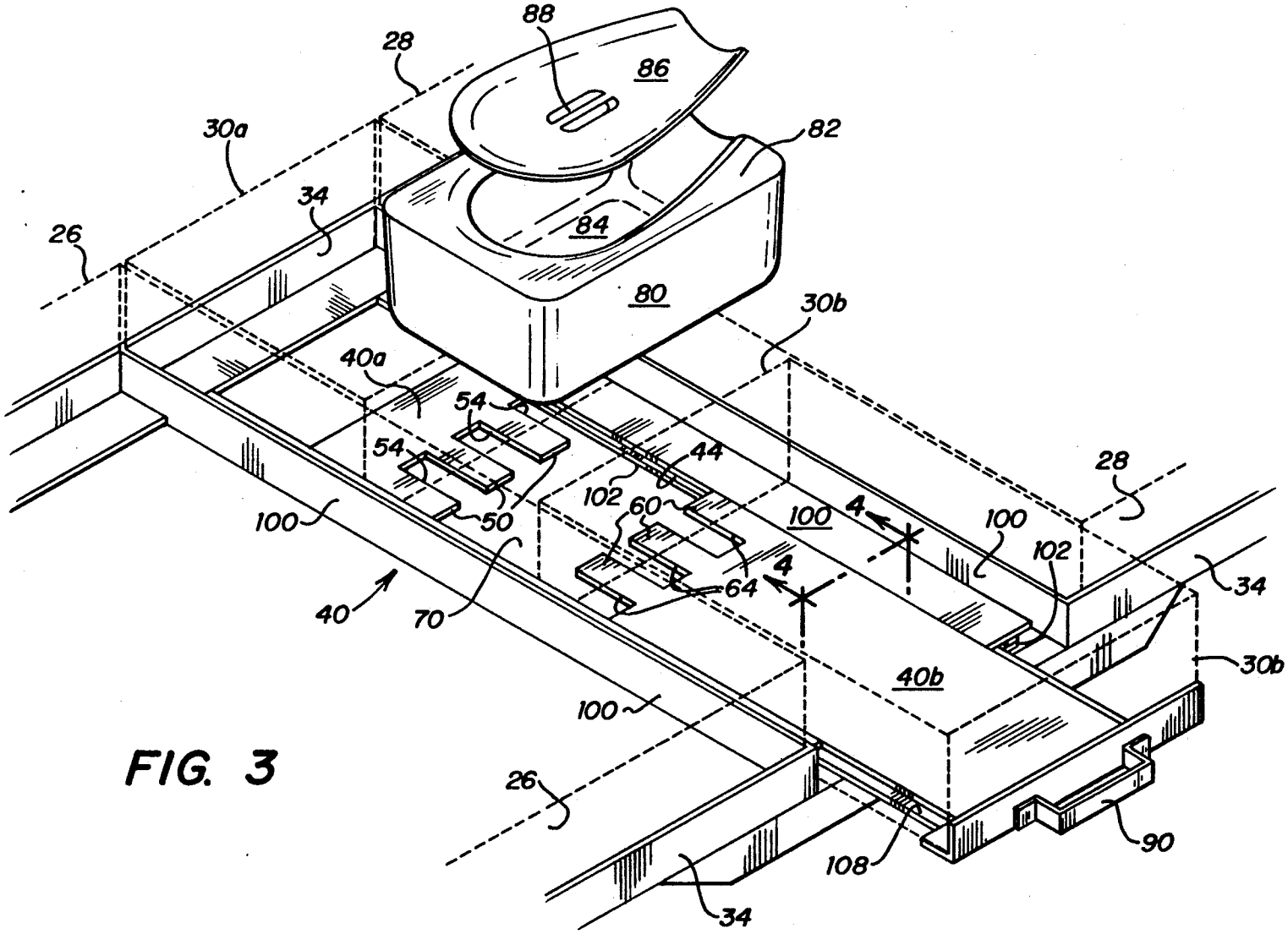
FIG. 3 is an exploded perspective view illustrating the plate in the open position and a bed pan in accordance with the present invention.

As more clearly illustrated in FIGS. 2 and 3, medial section 30 of mattress 24 includes sections 30*a* and 30*b*. Mattress sections 30*a* and 30*b* of medial section 30 are disposed between head section 26 and foot section 28 of mattress 24. Medial section 30 is supported on frame 34. Frame 34 includes a plate 40 having a fixed portion 40*a* and a slidable portion 40*b*. Slidable portion 40*b* of plate 40 is mounted in a track 44 for slidable movement therein transverse to frame 34. Mattress section 30*b* of medial section 30 is disposed on plate 40*b* for slidable movement between head section 26 and foot 25 section 28 of mattress 24.

Plate 40*a* includes tabs 50 which are spaced apart by gaps 54. Plate 40*b* includes tabs 60 which are spaced apart by gaps 64. In the closed position of plate 40*b*, tabs 60 are aligned with gaps 54 of plate 40*a* and tabs 50 are aligned with gaps 64 of plate 40*b* to form a continuous surface for mattress medial section 30. When plate 40*b* is slid outwardly of bed 10, as illustrated in FIGS. 2 and 3, a recess 70 is formed between sections 30*a* and 30*b* of mattress medial section 30. Recess 70 accommodates a bed pan generally identified by the numeral 80. Bed pan 80 is supported by tabs 50 and 60 within recess 70. Bed pan 80 approximates the height of mattress 24 such that the top of bed pan 80 is continuous with the top of mattress 24, when bed pan 80 is inserted within recess 70.

Bed pan 80 includes a seat portion 82 which has a configuration similar to a standard bathroom commode seat. Seat 82 includes an opening 84 into bed pan 80. Opening 84 is slanted slightly downwardly and generally shaped like that of a standard bathroom commode seat and measures, for example, 8½" in width and 11¾" in length. Opening 84 of bedpan 80 is provided with a cover 86 with a handle 88. After use, bed pan 80 can be covered utilizing cover 86 for removal of bed pan 80 from hospital bed 10.

Plate 40*b* is provided with a handle 90 for sliding plate 40*b* outwardly of bed 10 to move mattress medial section 30*b* outwardly of bed 10 in order to create recess 70 for receiving bed pan 80.

Figure 4:
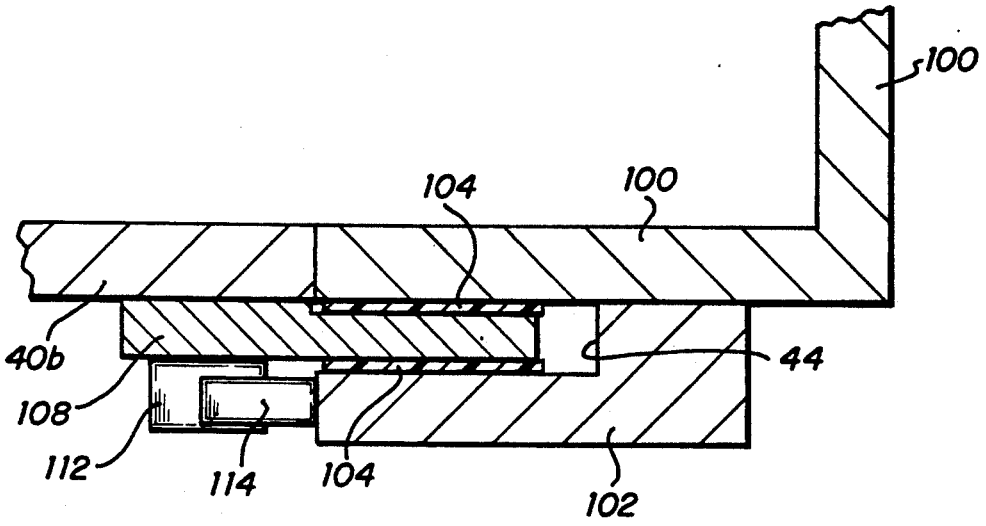
FIG. 4 is a sectional view taken generally along sectional lines 4—4 of FIG. 3.

Referring simultaneously to FIGS. 3 and 4, track 44 is formed through the use of an upper bracket 100 and a lower bracket 102. Upper bracket 100 is attached to frame 34. Lower bracket 102 is attached to upper bracket 100. Track 44 is disposed between brackets 100 and 102. Interconnected to the lower surface of bracket 100 and the upper surface of bracket 102 are guide surfaces 104 which may comprise, for example, nylon or Teflon ® to provide a frictionless surface for sliding movement of a track plate 108. Track plate 108 is mounted to plate 40*b* and is received between surfaces 104 of track 44. Plate 40*b* is mounted to track 44 via track plate 108 which slides within track 44 between upper bracket 100 and lower bracket 102.

Figure 5:
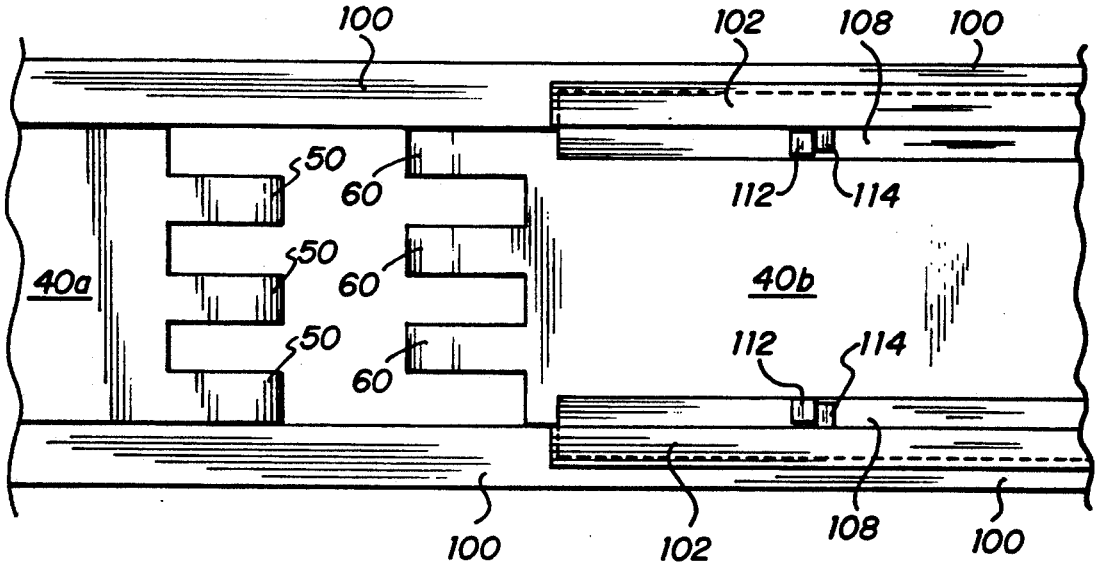
FIG. 5 is a partial bottom plan view of the plate in the open position.

Referring simultaneously to FIGS. 4 and 5, interconnected to track plate 108 is a block 112. Interconnected to lower bracket 102 is a block 114. Block 114 operates as a stop to prevent plate 40b being completely removed from frame 34 of bed 10 when block 112 abuts block 114.

As illustrated in FIG. 1, head section 26 may be movable to a semi-vertical position to accommodate a patient utilizing bed pan 80. As an alternative to the plate 40 described herein, plate 40a may also be slidable outwardly of frame 34, such that both plates 40a and 40b are partially slid outwardly of bed 10 to create recess 70 for insertion of bed pan 80. If desirable, medial sections 30a and 30b can be both slid outwardly of frame 34 through operation of only one of plates 40a or 40b by interconnecting a control mechanism between plates 40a and 40b. Plates 40a and 40b may comprise, for example, rigid steel in order to provide sufficient support for frame 34 as well as providing support for bed pan 80.

It therefore can be seen that the present invention provides for a hospital bed and bed pan insert which results in a simple, practical and inexpensive solution to the unpleasant hospital bed pan problem.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A bed for use with a bed pan comprising:

a mattress including a head section, a foot section, and a medial section disposed between said head and foot sections;

a frame for supporting said mattress sections;

a plate disposed within said frame for supporting said mattress medial section, said plate being mounted within said frame for horizontal slidable movement between a closed position in which said mattress sections form a continuous surface for the bed, and an open position transverse of said frame to create a recess in said mattress medial section thereby moving said mattress medial section outwardly of said frame;

said plate includes a plurality of tabs and said frame includes a plurality of mating tabs for receiving said plate tabs to form a continuous surface below said mattress medial section in said plate closed position; and a bed pan adapted to be disposed within said recess and supported by said plate tabs and said frame tabs when said plate is in said open position.

2. The bed of claim 1 wherein said bed pan includes a cover.

3. The bed of claim 1 wherein said mattress medial section includes first and second portions, said first portion being supported by said frame and said second portion being supported by said plate, said recess formed between said first and second mattress section portions when said plate is in the open position.

* * * * *